United States Patent [19]

Carlson et al.

[11] Patent Number: 4,501,566

[45] Date of Patent: Feb. 26, 1985

[54] METHOD FOR ASSEMBLING A HIGH VACUUM ROTATING ANODE X-RAY TUBE

[75] Inventors: Roland W. Carlson, Lyndhurst; Edward A. Blaskis, Hudson, both of Ohio

[73] Assignee: Technicare Corporation, Solon, Ohio

[21] Appl. No.: 533,704

[22] Filed: Sep. 19, 1983

[51] Int. Cl.[3] ..... H01J 9/00

[52] U.S. Cl. ..... 445/28; 313/40; 29/460; 277/1

[58] Field of Search ..... 445/28, 23, 33, 54, 445/57, 39, 40; 277/1, 9, 9.5, 58, 80; 313/40; 29/460

[56] References Cited

U.S. PATENT DOCUMENTS

| | | | |
|---|---|---|---|
| 3,846,006 | 11/1974 | Atlee et al. | 445/28 |
| 4,144,471 | 3/1979 | Hartl | 313/40 |
| 4,309,637 | 1/1982 | Fetter | 313/40 |

*Primary Examiner*—Kenneth J. Ramsey
*Assistant Examiner*—Kurt Rowan
*Attorney, Agent, or Firm*—Michael A. Kaufman

[57] ABSTRACT

A method of vacuum assembling a rotating anode X-ray tube of the type having a rotor and a shaft extending therefrom with a magnetic fluid for vacuum sealing about the shaft. The tube is subjected to a high temperature bake-out whereby gases are sufficiently evolved from exposed metal parts that a stable low pressure region is created. A static seal is used to temporarily seal the region during bake-out with the anode temporarily rendered non-rotatable and the permanent magnetic vacuum seal protected from the high temperature. The system is then allowed to cool off before the permanent magnetic vacuum seal is moved into its operational position within the high vacuum. Assembly tooling is provided ensuring that the high vacuum is maintained throughout the installation. Bearings are installed external to the region of high vacuum to transmit rotary motion of the shaft through the permanent seal. Finally, the tube is rendered operational by displacing the static seal thereby permitting the anode to be rotated.

7 Claims, 9 Drawing Figures

METHOD FOR ASSEMBLING A HIGH VACUUM ROTATING ANODE X-RAY TUBE

FIELD OF THE INVENTION

The present invention relates to a rotating anode x-ray tube using a magnetic fluid seal and, in particular, to a method of vacuum assembling such a tube having a stable, high vacuum, particularly desirable in such mobile applications as rotational-type CT scanners.

BACKGROUND OF THE INVENTION

The x-ray tube is an integral and critical part of a CT scanner and represents a relatively expensive component that is frequently the failure mode of the scanner. Ideally, an x-ray tube for CT scanner application must have long tube life under continuous high mA scans and high patient throughput.

As is well known, x-rays are generated in vacuum tubes that comprise an anode and a cathode generally referred to as an electron gun which in turn includes a heatable tungsten filament connected to a high voltage source adapted for emitting a high energy beam of accelerated electrons. The anode is in the form of a metal target displaced a short distance from the cathode. When an accelerated electron beam strikes the metal target on the anode, x-rays are generated within the region of the beam's focus. The impact, through a relatively inefficient process, generates x-rays also known as Bremsstrahlung or breaking radiation. Since only about one percent of the total energy of the accelerated electrons is converted to electromagnetic radiation, a large amount of thermal energy is created at the focal region of the target.

In conventional, fixed anode x-ray tubes the debilitating effect of this resultant head effect is minimized by providing the anode with a through flow of cooling fluid to help dissipate the heat. Nonetheless, the generation of considerable heat at a fixed focal spot creates gross limitations on the energy output capacity of the tube as well as on its limits of continuous operability.

A significant improvement was achieved by the rotating anode x-ray tube which expanded the focal spot on the target from a point to a circle. At first, such rotating anode tubes relied on radiation for heat dissipation; however, this too, quickly proved to be limiting. Although efforts for providing through flow cooling were suggested, such as for example, by Fetter in U.S. Pat. No. 4,309,637, rotating type tubes created a new set of problems. The evacuated region of the tube must be sealed to maintain the necessary vacuum.

A most significant consideration in the design of such rotating anode x-ray tubes is the method of sealing the evacuated region about the rotary shaft. Yoshimatsu and Kozaki catalogue a variety of techniques for applying vacuum sealing to the anode rotary shaft in "High Brilliance X-Ray Sources", Topics in Applied Physics, Volume 22, X-Ray Optics, edited by H. J. Queisser, Springer Verlag, 1977. A relatively recently devised method utilizes a magnetic vacuum seal. A problem that has prevented the widespread use of this new technology is its inability to withstand high temperatures required in high-temperature bake-out, a common technique for evolving gasses from metal parts to assure a maintainable high vacuum.

SUMMARY OF THE INVENTION

We have invented a vacuum installation method for assembling a high vacuum rotating anode x-ray tube of the type subjected to a high-temperature bake-out process and which utilizes a magnetic fluid vacuum seal about the rotary shaft of the anode. The x-ray tube is assembled with the aid of a static temporary hollow metal O-ring that can withstand the high temperatures to which the metal parts in the system are subjected for degassing the system to ensure a high vacuum in the x-ray generating region. Once the high vacuum is obtained, the permanent magnetic seal utilizing magnetic fluid is introduced into the system without destroying the high vacuum.

In a preferred embodiment, our x-ray tube is all metal and ceramic and provides a stable high vacuum region that permits virtually continuous operation on the gantry of a rotational-type CT scanner for approximately 30 days without maintenance.

While the invention will be described particularly in connection with rotational CT scanner application, it will be appreciated that the x-ray tube is useful in a variety of x-ray settings, such as, for example, x-ray diffraction applications and digital x-ray imaging.

BEST MODE FOR CARRYING OUT THE INVENTION

Figure 5:
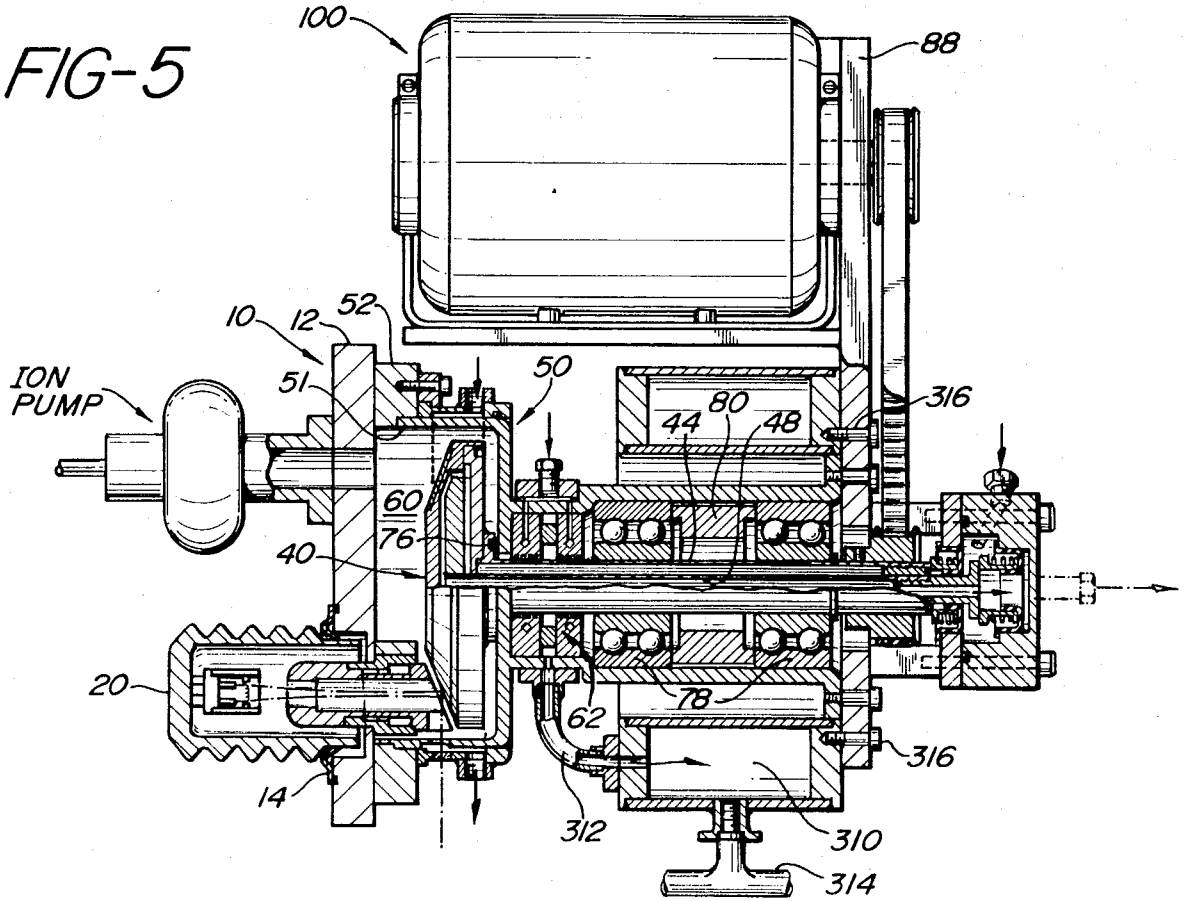
FIG. 5 is an assembly drawing, partially in section, illustrating the assembled x-ray tube together with its mounting assembly.

Referring first to FIG. 5, there is shown an assembled rotating anode x-ray generating vacuum tube referred to generally as 10 together with a drive motor assembly referred to generally as 100. The drive motor assembly provides the necessary rotation of the tube. Both tube 10 and the assembly 100 are adapted for mounting on a gantry of a rotating type CT scanner (not shown). The x-ray tube 10 comprises an electron gun 20 connected to a high voltage source (not shown) which serves as the cathode of the vacuum tube and a rotating anode assembly 40 which will be described below with primary reference to FIG. 6.

Figure 6:
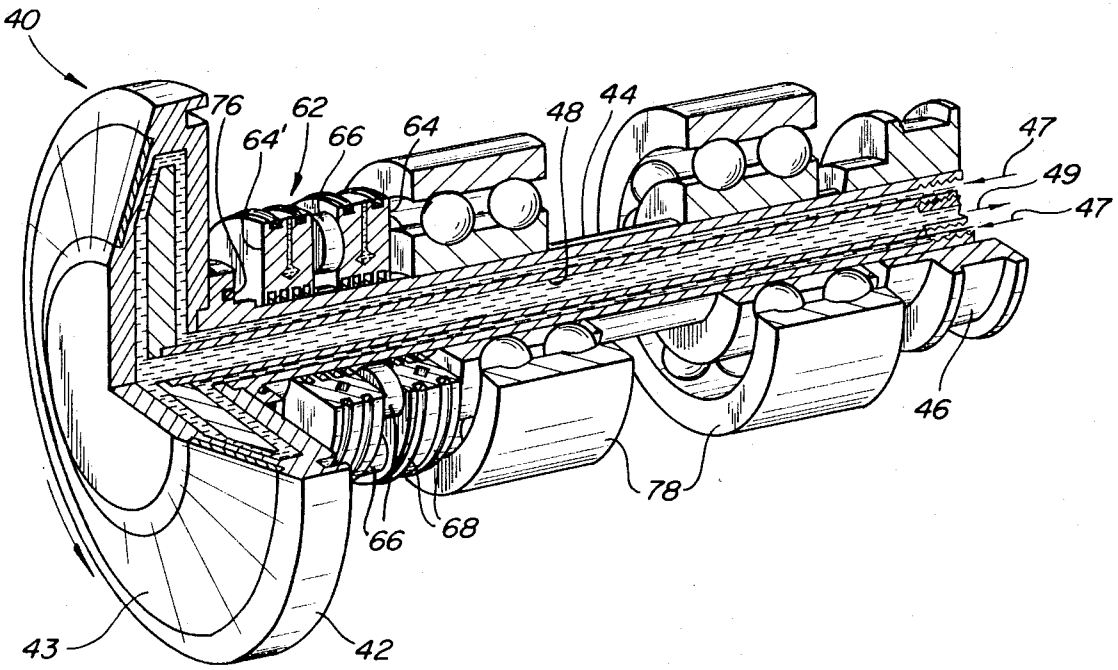
FIG. 6 is a perspective view, partially in section, of portions of the x-ray tube illustrated in FIG. 5.

As shown in FIG. 6, the rotating anode assembly 40 includes a rotatable generally disk-shaped stainless steel rotor 42 and stainless steel shaft 44. The rotor 42 has a beveled frontal portion including an annular hardened portion 43, preferably of plasma sprayed tungsten, which serves as the target. The function of target 43 is to decelerate the high energy electrons emitted by the electron gun 20 to thereby generate x-rays.

Extending away from the rotor 42 is the shaft 44 whose remote end is surrounded by a drive pulley 46 for connection to the motor drive assembly 100. The shaft 44 includes a concentrically disposed hollow internal shaft 48, best illustrated in FIG. 3. The region between the exterior of the internal shaft 48 and the interior of shaft 44 defines an annular passageway 47 for the introduction of a coolant such as water, into the anode assembly 40. As a result of the considerable heat generated at the target, the water is heated as it flows past the target. The heated water routs through the interior of internal shaft 48 which defines a cylindrical exiting passageway 49 for the discharge of the heated fluid. The remote ends of the two shafts are threadably engaged to ensure retention of the internal shaft 48 in concentric relationship inside shaft 44.

As is well known, the region between the target of the anode and the electron gun or cathode of the x-ray tube must be maintained in a high vacuum, here defined by a stainless steel housing 50 which includes base plate 12, sleeve 51, and main flange 52. As is shown in FIG. 5, electron gun 20 is mounted through an opening in stainless steel base plate 12. Sleeve 51 which is attached to base plate 12 by means of main flange 52 serves as an enclosure for rotor 42 and together with base plate 12 defines a region 60 which is evacuated to a high vacuum, i.e., on the order of $10^{-7}$ Torr. A simple low volume ion pump such as one made by Varian Associates, Palo Alto, CA is mounted on base plate 12 and serves as a getter to help maintain the high vacuum. Since electron gun 20 is mounted in fixed relation within base plate 12, an annular static seal 14 provides the necessary sealing therebetween. The anode assembly 40, however, requires rotation and, hence, creates a far more difficult vacuum sealing problem. Proper sealing between the evacuated region 60 and the shaft 44 of the anode assembly is provided by a magnetic seal assembly 62 which utilizes a magnetic or ferrofluidic seal to provide coaxial liquid sealing about the shaft 44. Magnetic fluid as well as magnetic seal assemblies are available from the Ferrofluidics Corporation of Nashua, N.H. 03061.

Figure 3:
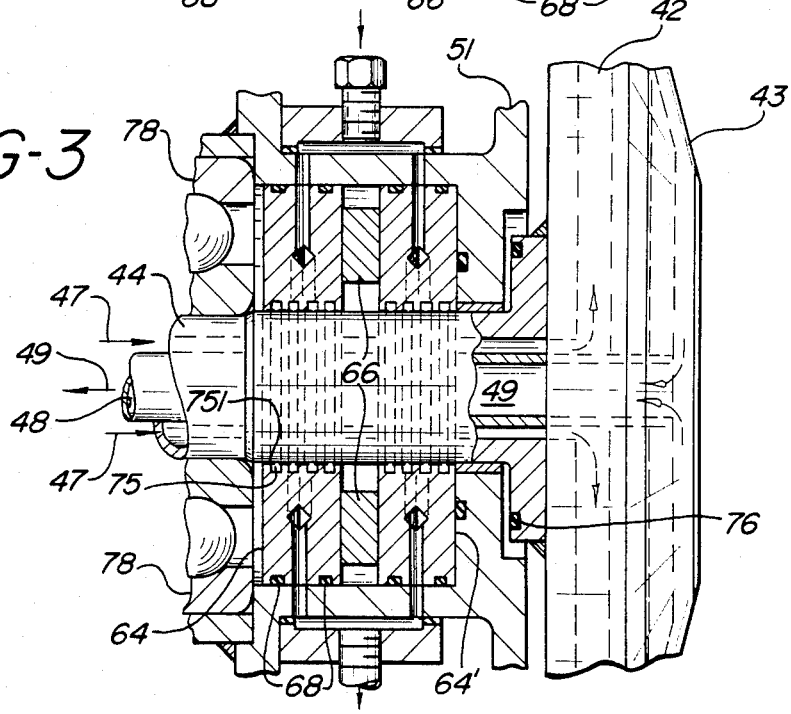
FIG. 3 is a sectional view of a portion of an assembled x-ray tube illustrating in detail a magnetic seal assembly.

The magnetic ferrofluidic seal assembly 62 is shown in place disposed about shaft 44 in the sectional detailed illustration of FIG. 3. The ferrofluidic seal 62 includes a pair of annular pole pieces 64, 64' disposed about the shaft 44 and separated from each other by a plurality of magnets 66 sandwiched therebetween and arranged in a circle about the shaft. The magnetic pieces 66 are axially polarized. Magnetic fluid is placed in the gap between the inner surfaces of the stationary pole pieces 64, 64' and the outer surface of the rotary shaft 44. In the presence of a magnetic field, the ferrofluid assumes the shape of a liquid O-ring to completely fill the gap. Static sealing between outer portions of the two pole pieces and the interior of housing 50 is provided by means of elastomeric O-rings 68, two embedded in each pole piece.

The interior of each pole piece is provided with a plurality of parallel annular grooves 75 wherein the high regions 751 adjacent said grooves represent the closest distance between the shaft and the pole pieces and hence, define the region where the ferrofluid is focused. FIG. 3 also illustrates an annular temporary static seal such as hollow, metal O-ring 76 disposed in the rotor and spaced apart from sleeve 51 of housing 50. Unlike the magnetic seal assembly and elastomeric O-rings 68, temporary seal 76 can withstand temperatures in excess of 350° C. It serves no purpose in the operation of the x-ray tube, but is used to temporarily seal the evacuated region during a high temperature bake-out procedure in lieu of the magnetic seal assembly as will be described below.

Each such annular ring of ferrofluid serves as an independent seal in the system. After assembly, as diagrammatically illustrated in FIG. 2, the pressure between each adjacent pair of annular magnetic seals in the pole piece 64', adjacent said evacuated region 60, is at approximately 0 psi, while the pressure gradient across the other pole piece 64 rises incrementally from 0 psi intermediate the two pole pieces 64, 64' to 15 psi or atmospheric pressure (approximately 760 Torr) on the other side.

With the aid of the magnetic fluid, the anode can be rotated in a fashion that permits maintenance of the high vacuum in the evacuated region 60 without the need for bearings inside the high vacuum. Thus, as can be seen in FIG. 5, there are no bearings in the evacuated region 60. A pair of high durability bearings 78 separated by a spacer 80 are disposed about the shaft 44 outside of the evacuated region where they are provided with conventional lubricants, assuring long life.

Figure 1:
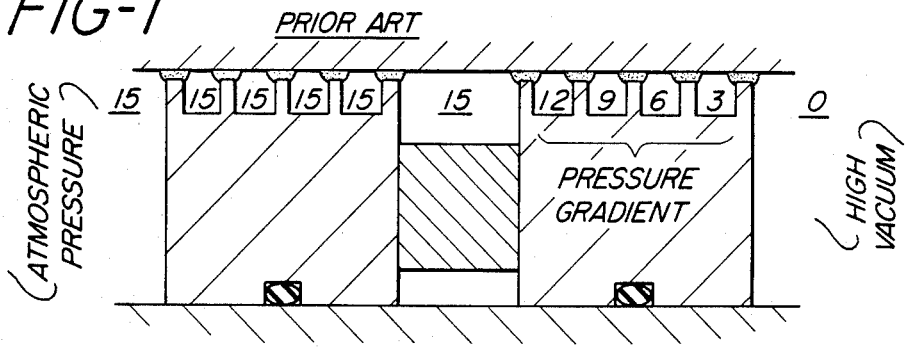
FIG. 1 is a prior art diagrammatic representation illustrating the results of standard atmospheric loading of a magnetic fluid seal about the rotating axis of a rotating anode x-ray tube.
Figure 2:
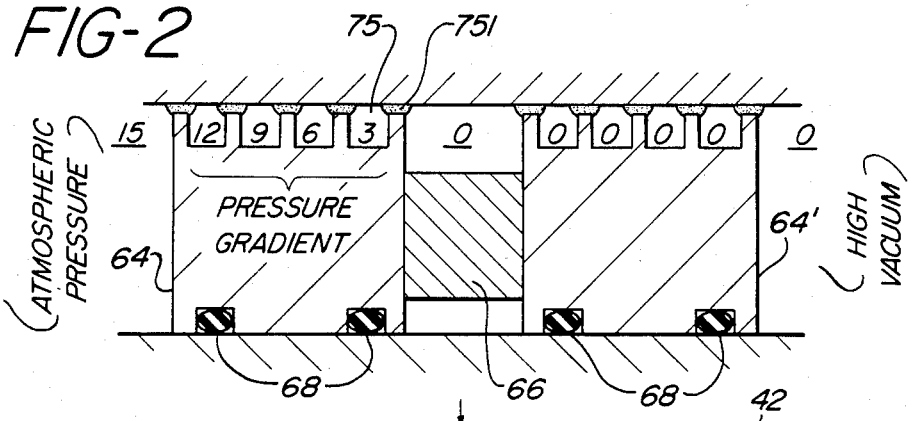
FIG. 2 is a diagrammatic representation similar to FIG. 1, illustrating the results of vacuum loading a magnetic fluid seal in accordance with the present invention.

Since, in a preferred embodiment, the entire unit is mounted on the gantry of a CT scanner, it is important that the tube require minimum service. To maintain long use from the tube, it is essential that the evacuated region 60 be maintained at the requisite high vacuum. In testing, it has been found that there is a very small, but detectable, gas flow through the cylindrical interface between the seal assembly 62 and the anode shaft 44. This condition results in pressure build up and subsequent over pressure valving action at the interface between the high vacuum region 60 and the pole piece 64'. This situation will continue as long as there is a pressure gradient across the pole piece adjacent the high vacuum region as in the prior art illustration of FIG. 1. To avoid such over pressure valving of the high vacuum seal assembly interface, it has been found that the region between the two pole pieces must be maintained at a pressure below 100 millibars ($\approx$75 mm Hg or about 75 Torr). To assure that this condition is maintained over a substantial period of time, a donut-shaped ballast volume 310 is fitted about shaft 44 in concentric relationship with bearings 78. The ballast volume is in pressure communicating relationship with the magnetic seal assembly 62 via conductor tube 312. The ballast volume is also provided with a T-fitting 314 one stem of which is connected to a guage (not shown) for reading the internal pressure in the volume while the other stem is connected to a bleed off valve (also not shown) for periodically relieving the pressure that builds up inside the volume. With the augmented volume provided by ballast volume 310, the pressure intermediate the two pole pieces 64, 64' is maintained below the 100 millibar level for approximately one month before the ballast volume needs to be valved. Under this arrangement, the pressure gradient is placed across pole piece 64 as illustrated in FIG. 2 when assembly of the tube is carried out in accordance with the below described method. Hence, pressure build up at the high vacuum interface is avoided.

METHOD OF ASSEMBLY

Figure 4A:
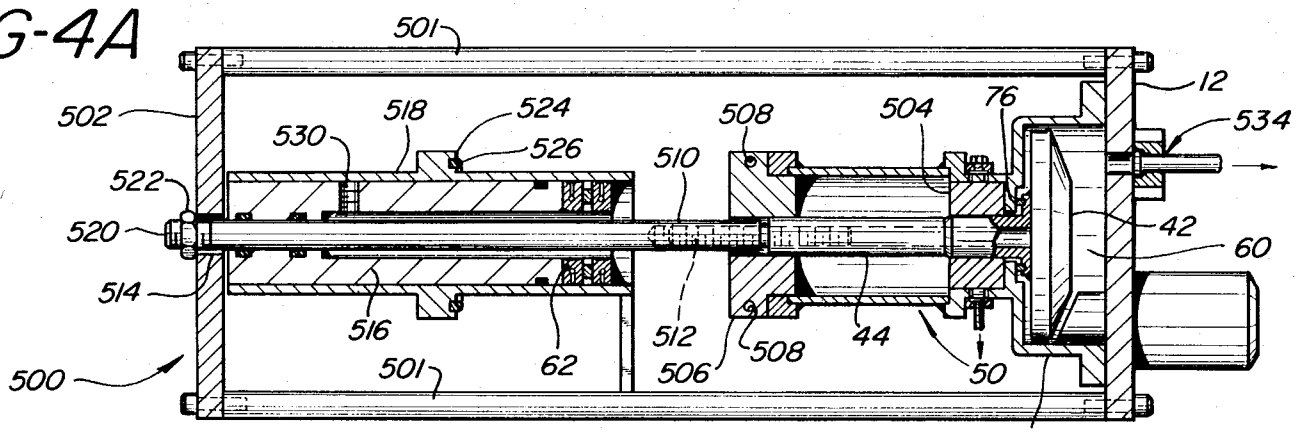
FIGS. 4A–4D are diagrammatic representations, partially in section, of assembly tooling used in assembling the rotating anode x-ray tube and illustrating in sequence the assembly process.

FIGS. 4A–4D illustrate assembly tooling used in the vacuum assembly procedure. FIG. 4A, representative of the first step of the assembly procedure, illustrates assembly tooling referred to generally by the numeral 500 which includes four one-inch stainless steel rods (two shown) 501 collectively supporting stainless steel base plate 12 of the x-ray tube 10 at one end and a support cross bar 502 at the other. The assembly tooling 500 also includes an annular cylindrical split bushing 504 and temporary split clamp 506. Split bushing 504 is fabricated from aluminum and has an inside diameter that is designed to fit about shaft 44 of the rotating anode assembly 40 and an outer diameter configured and dimensioned to slip fit within the anode housing as shown in FIG. 4A. Similarly, split clamp 506, which is made of brass, is configured and dimensioned to fit about the shaft 44 and partly within the remote end of the housing 50. The combination of the split bushing 504 and the split clamp 506 serves to center the shaft of the anode assembly within its housing. Split clamp 506 is provided with a pair of screws 508 with which the axial position of the shaft of the x-ray tube is locked into place. The annular temporary static seal 76 disposed on rotor 42 is shown spaced apart from sleeve 51 of housing 50. The assembly tooling further includes a stainless steel three-quarter inch diameter pull rod 510 complete with threading 512 for mating engagement with the free end of shaft 44. Surrounding pull rod 510 is a cylinder piston loading assembly including cylinder 518 and annular piston 516, the latter interposed between the piston and pull rod. Cylinder 518 is provided with an enlarged annular portion 524 that includes an elastomeric O-ring 526. Piston 516 is shorter than cylinder 518, forming a recess within which magnetic vacuum seal assembly 62 fits.

The assembly process, as shown in FIG. 4A, commences with (a) installation of the split bushing and the split clamp about the rotor of the anode. Then (b) the cylinder piston loading assembly complete with magnetic seal assembly 62 is slid about the pull rod with the rod threadably engaged to shaft 44. To secure the alignment of pull rod 510 with shaft 44, support cross bar 502 is mounted (c) on the four stainless steel rods 501. Support cross bar 502 includes a centrally positioned annular opening 514 through which the free end 520 of pull rod 510 extends. Pull rod 510 is then secured in its aligned position by means of nut 522 that threadably engages the free end 520 of the pull rod. Nut 522 is then (d) wrenched down against support cross bar 502 pulling rotor 42 against sleeve 51, thereby forcing temporary seal 76 in vacuum sealing engagement with anode housing 50. Thus, pull rod 510, is drawn an amount sufficient to crush hollow metal O-ring 76. The split clamp 506 and the split bushing 504 are then (e) removed and (f) a leak check is performed in region 60 to be certain that temporary seal 76 is in proper sealing engagement with housing 50.

Figure 4B:
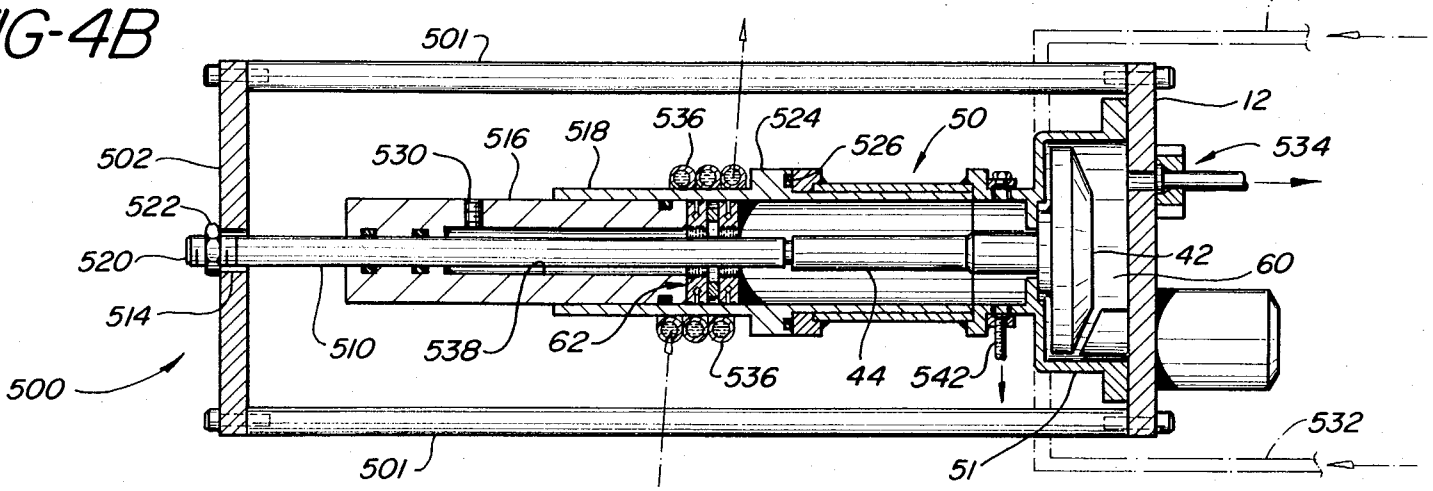

Referring now to FIG. 4B, the assembly continues as follows. The loading assembly with magnetic seal 62 is (a) slid further down the pull rod until the leading edge of annular portion 524 abuts against anode housing 50, as shown, for telescopic engagement with the housing. The elastomeric O-ring 526 provides the necessary vacuum sealing therebetween. Thereafter, (b) bake-out oven 532, shown in phantom, is lowered over the portion of anode assembly housing 50 which encloses the evacuated region 60. Preferably, the oven 532 includes an electric heating element disposed on an insulated aluminum container. A vacuum pump connection 534 disposed in base plate 12, in communicating relation with the evacuated region 60, is provided to pump out the region during the bake-out process. Region 538 internal said piston 516, but separated from region 60 by temporary seal 76 is also pumped out. This is accomplished by means of a mechanical vacuum pump (not shown) connected to the ballast volume 310 through mechanical vacuum pump connection 542 which is disposed about housing 50 in pressure communicating relationship with region 538. Cooling coils 536 are arranged helically disposed about cylinder 518 to provide fluid cooling during the baking process. With the bake-out oven in position and the vacuum pump 534 operational, the bake-out (c) proceeds for approximately 16–24 hours at about 350° C. The magnetic seal assembly complete with the magnetic fluid is maintained outside of the oven and is cooled by the cooling coils 536 or, alternatively, by a fan to prevent the magnetic fluid from boiling. Since the evacuated region must be brought down to a pressure of around $10^{-7}$ Torr or less, the bake-out is crucial in order to evolve or desorp the gases from the metal parts forming the anode housing as well as from the rotor 42 of the anode assembly. This bake-out procedure ensures that subsequent evolution of gases will be reduced to a minimum thereby permitting maintenance of such a low stationary pressure with but a small ion pump connected to the evacuated region. This is so since the ultimate pressure obtained in the region represents an equilibrium state between the rate at which gas is evolved from the walls and internal metal parts and diffused through the annular interface between the shaft and the permanent magnetic seal and the rate at which these gases are removed. Completion of the bake-out process represents the end of the steps illustrated by FIG. 4B.

Figure 4C:
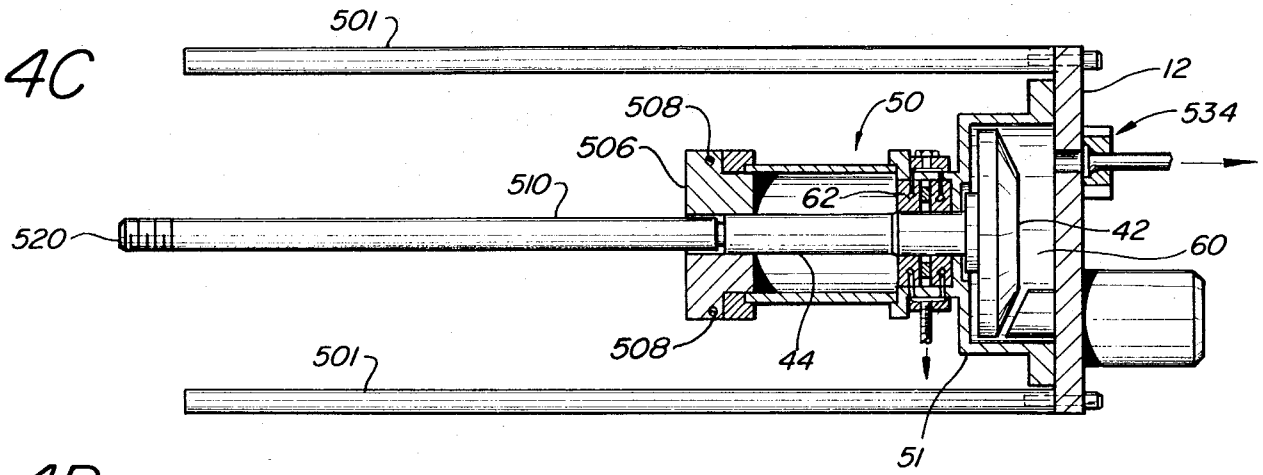

The bake-out oven 532 is then (a) displaced, and the system is allowed to cool down to room temperature which takes about three hours. Thereafter, (b) the piston 516 is slid further down pull rod 510 pressing the magnetic seal assembly into its operational position within housing 50, as shown in FIG. 4C. Cylinder 518 remains stationary during this step since it is already abutting against and telescopically engaged within the housing, as shown in FIG. 4B. Once this is accomplished, (c) tapped hole 530 within piston 516 is vented, permitting region 538 internal said piston to go to atmospheric pressure. With the high vacuum maintained in region 60, the loading assembly (d) is retracted to the left to its former position, as shown in FIG. 4A, limited only by the support cross bar 502. The temporary split clamp 506 is then (e) reinserted about the anode shaft and friction fit within housing 50, as shown in FIG. 4C, and secured in position with split clamp screws 508. This clamps the shaft and housing permitting removal (f) of nut 522 without losing the tension on the shaft that maintains the static seal 76 operational. Lastly, (g) the tension on the pull rod 510 is released, the cylinder piston loading assembly is extracted, and the support cross bar 502 is removed. The completion of this step corresponds to the depiction of FIG. 4C.

Figure 4D:
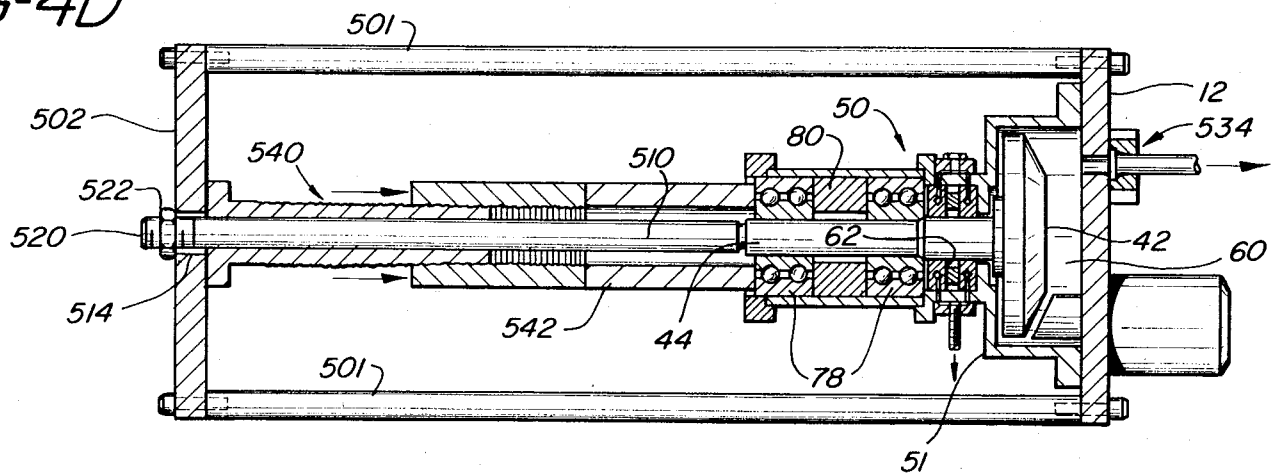

Finally, as shown in FIG. 4D, the bearings are installed. The first step in this procedure is (a) to sequentially slide the first bearing 78 and then spacer 80 and then the second bearing 78 about pull rod 510 until the first bearing 78 abuts against temporary split clamp 506 which is still maintained in the position shown in FIG. 4C. Then, (b) specially designed telescopic cylindrical pressing member 540 is positioned about pull rod 510. Then, (c) support cross bar 502 is replaced, permitting (d) replacement of nut 522 to once again place tension on the pull rod. With tension on the pull rod 510, the integrity of the sealing of evacuated region 60 is ensured and (e) the temporary split clamp may finally be removed. With the clamp removed, (f) the outer portion 542 of the cylindrical assembly 540 is advanced to press fit into position the bearing and spacer assembly within housing 50, as shown in FIG. 4D. At this time, (g) the assembly tooling is removed and (h) the shaft 44 is displaced to the right relative to the bearings and housing a slight distance of approximately 1/16 of an inch to provide clearance between the temporary seal 76 and the housing, thereby permitting the shaft to rotate. The x-ray tube is now operational.

The above-described vacuum installation of the magnetic seal assembly places the pressure gradient in the seal on the atmospheric side of the seal across pole piece 64, as shown in FIG. 2. This produces a highly redundant set of subseals, one at each region 751, with very low internal pressures across pole piece 64' between the pressure gradient and the high vacuum of region 60. Thus, in contrast to the condition illustrated in FIG. 1, that results from prior art atmospheric installations valving action in the subseals at the higher pressures is isolated from the high vacuum 60 side of the magnetic sealing assembly.

We claim:

1. A method of assembling a rotating anode x-ray tube of the type having an anode mounted for rotation about an axis thereof, the anode having a rotor and a shaft extending therefrom, a temporary static seal disposed on said rotor, a housing enclosing portions of said rotor and defining therewithin an evacuable region of high vacuum, a magnetic seal assembly disposed about the shaft of said anode for fluidically vacuum sealing said region while permitting rotation of said shaft, and bearing means disposed about said shaft outside of said region for transmitting rotary motion of said shaft through said fluidic vacuum seal, the steps comprising:

(a) compressing said temporary seal so as to immobilize said rotor and seal said region;

(b) lowering the pressure within said region to a sufficiently low level that permits maintenance therein of a stable high vacuum requiring only a small mobile vacuum pump;

(c) installing the magnetic seal assembly about said shaft while maintaining said high vacuum;

(d) installing the bearing means about said shaft adjacent said magnetic sealing assembly and outside of said region of high vacuum; and (e) releasing said rotor to permit rotation of said anode.

2. The method according to claim 1 wherein said temporary seal is compressed against said housing during the steps of lowering the pressure, installing the magnetic sealing assembly, and installing the bearing means.

3. The method according to claim 2 wherein the step of compressing said temporary seal includes placing tension on the shaft of the anode such that said rotor abuts against the housing.

4. The method according to claim 1 wherein said step of lowering the pressure within said region includes degassing said rotor and interior portions of said housing.

5. The method according to claim 4 wherein said degassing step includes subjecting a portion of said housing to temperatures of approximately 350° C. or more for a period of approximately 16 to 24 hours.

6. The method according to claim 5 further comprising the step of cooling the magnetic sealing assembly during the degassing step.

7. The method according to claim 5 wherein said degassing step further comprises pumping out said region.

* * * * *